United States Patent [19]

Altenau et al.

[11] Patent Number: 5,076,171

[45] Date of Patent: Dec. 31, 1991

[54] BOMBLET CARRIER PROJECTILE EQUIPPED WITH LIGHTWEIGHT TRAINING BOMBLETS ARRANGED IN LAYERS

[75] Inventors: Ernst-Wilhelm Altenau, Duisburg; Siegmar Fischer; Margret Palten, both of, Düsseldorf, all of Fed. Rep. of Germany

[73] Assignee: Rheinmetall GmbH, Düsseldorf, Fed. Rep. of Germany

[21] Appl. No.: 597,337

[22] Filed: Oct. 15, 1990

[30] Foreign Application Priority Data

Oct. 14, 1989 [DE] Fed. Rep. of Germany ..... 3934362

[51] Int. Cl.[5] ..... F42B 12/62

[52] U.S. Cl. ..... 102/489; 102/334; 102/357; 102/393

[58] Field of Search ..... 102/334, 340, 342, 345, 102/351, 352, 357, 360, 395, 393, 489, 498, 505

[56] References Cited

U.S. PATENT DOCUMENTS

| | | | |
|---|---|---|---|
| H, 699 | 11/1989 | Thomas, Sr. | 102/489 |
| 3,049,080 | 8/1962 | Schermuly | 102/357 |
| 3,323,456 | 6/1967 | Rothman | 102/ |
| 3,492,945 | 2/1970 | Filippi | 102/498 |
| 3,902,683 | 9/1975 | Bilsbury | 102/515 |
| 4,406,227 | 9/1983 | Beeker et al. | 102/489 |
| 4,444,111 | 4/1984 | Luebbers | 102/334 |
| 4,714,020 | 12/1987 | Hetsgaard et al. | 102/351 |
| 4,791,870 | 12/1988 | Simpson | 102/342 |
| 4,793,260 | 12/1988 | Kruse et al. | 102/489 |
| 4,869,174 | 10/1989 | Hanser et al. | 102/489 |

FOREIGN PATENT DOCUMENTS

| | | | |
|---|---|---|---|
| 2437535 | 2/1976 | Fed. Rep. of Germany | 102/489 |
| 3808898 | 9/1989 | Fed. Rep. of Germany . | |
| 3841649 | 9/1990 | Fed. Rep. of Germany . | |

*Primary Examiner*—Harold J. Tudor
*Attorney, Agent, or Firm*—Spencer & Frank

[57] ABSTRACT

A bomblet carrier projectile for delivering training bomblets to a target area. A plurality of training bomblets are supported in layers within the projectile body, with each training bomblet having a housing made of at least one of paper and plastic. A plurality of supporting elements are disposed within the projectile body and stackable in the axial direction of the projectile body for supporting the training bomblet housings in the layers. A detonator is arranged in a frontal region of the projectile body. A gas passage channel is formed along the longitudinal axis of the projectile body. An ejector unit is disposed behind the detonator and includes an ejection charge for emitting ignition gases when ignited by the detonator that are passed through the gas passage channel for igniting the training bomblets and an ejection plate for ejecting the training bomblets from the projectile body, over a target area, in response to pressure generated by the ignition gases.

14 Claims, 2 Drawing Sheets

BOMBLET CARRIER PROJECTILE EQUIPPED WITH LIGHTWEIGHT TRAINING BOMBLETS ARRANGED IN LAYERS

BACKGROUND OF THE INVENTION

The present invention relates to a bomblet carrier projectile including training bomblets arranged within a projectile body along with a detonator disposed in a frontal region of the body followed by an ejector unit composed of an ejection charge and an ejection plate by which the training bomblets are ignited through a gas passage channel disposed along the projectile axis and are ejected from the projectile body over a target area.

Bomblet carrier projectiles of the foregoing type are disclosed in German Patent No. 3,809,177 [and corresponding U.S Pat. No. 4,869,174], and in German Patent Application No. P 38 41 649.2. As disclosed in these documents, the training bomblets, which are to be transported to a target area and ejected at a given height, include a metal housing enabling each training bomblet to absorb acceleration forces from, for example, training bomblets that are stacked above it in the projectile body. However, the drawback of these training bomblets is that when they impact on a yielding ground, such as in deep mud, in a swamp, in snow, sand or water, the heavy metal housing will cause them to penetrate into the ground where they may sink. Thus, the desired specific ground dispersion pattern which is to occur upon impact in a manner similar to a live bomblet in the form of a detonation cloud with a flash and a sharp report or bang, if pyrotechnic ignition is employed, will no longer be discernible.

SUMMARY OF THE INVENTION

It is an object of the present invention to configure bomblet carrier projectiles and the training bomblets transported thereby so that the training bomblets are able to withstand the high acceleration forces generated during their transport into the target area and will not sink into a yielding ground upon impact.

The above and other objects are accomplished according to the invention by the provision of a bomblet carrier projectile for delivering training bomblets to a target area which includes a projectile body; an arrangement of a plurality of training bomblets supported in layers within the projectile body, each training bomblet comprising a housing made of at least one of paper and plastic; a plurality of supporting means disposed within the body and stackable in the axial direction of the body for supporting the housings of the training bomblets in the layers; a detonator arranged in a frontal region of the projectile body; and ejector means disposed behind the detonator and including an ejection charge for emitting gas and an ignition flame when detonated by the detonator, an ejection plate operatively disposed in relation to the ejection charge and gas channel means forming gas channels along the axis of the body for passing the gas and ignition flame from the ejection charge for igniting and ejecting the training bomblets over a target area.

The use, according to the invention, of a bomblet housing manufactured of a material based on paper and/or plastic produces a lightweight training bomblet which reduces the gross weight of the training bomblet to such an extent that deep penetration into a yielding ground is avoided and the signature with detonation cloud, flash and sharp report is easily discernible. The training bomblet housing produced of a material based on paper and/or plastic additionally is particularly advantageous from a safety standpoint because, compared to a training bomblet housing made, for example, by die casting, there is no danger from scattered fragments. In a training bomblet housing made of a material based on paper, a faulty ignition leaves no residues, which is another advantage compared to a metal housing, because the training bomblet will decompose soon due to, for example, moisture.

Although a training bomblet housing produced of a material based on paper and/or plastic encounters narrower limits with respect to stress, for example, from pressure, the support of the training bomblet according to the invention within the bomblet carrier projectile makes it possible for the training bomblets to withstand the high initial accelerations during transport into the target area so that they can be ejected over the target area in a known manner from the tail of the carrier projectile by way of an ejection charge.

Advantageously, according to the invention, the training bomblets are supported in layers within the carrier projectile so that the training bomblets disposed in one plane or layer, respectively, are supported in the axial direction of the projectile.

Further, according to another feature of the invention, the supporting arrangement includes disc-shaped support plates arranged transversely to the axis of the projectile and axial support elements disposed between the disc-shaped plates so that the training bomblets can be introduced into the projectile body and supported in layers. The arrangement of the training bomblets in layers is not fixed in the circumferential direction and may therefore differ from layer to layer. This results in simplified assembly.

The axial supports between the support plates ensure reliable maintenance of a supporting distance corresponding to the length of adjacent bomblets in a layer so that the individual training bomblets need not absorb additional axial forces from training bomblets of stacked layers ahead of them. The axial forces resulting from training bomblets stacked in layers on top of one another can thus have no negative influence on the stability of the bomblet housings according to the invention, with the stress of the initial acceleration being further reduced in an advantageous manner due to the reduced weight of the bomblet housings.

The axial supports may be arranged in the carrier projectile so as to lie against the projectile body filling the spaces between the training bomblets as space saving fillers or they may be arranged between two adjacent support plates as one-piece or multi-piece central supports in the free interior space formed by the training bomblets. This central support is provided with an axial gas passage channel in its interior for the ignition of all training bomblets disposed in the carrier projectile.

According to a further structural feature, the top face of each support plate is provided with connecting grooves which extend from the central gas passage channel to the individual training bomblets, so that the latter can be ignited from the bottom without additional means. The different axial supports also permit the installation of differently configured training bomblets.

Thus, the arrangement of external axial supports permits the installation of further training bomblets ignited from the side, for example, through bores in the sides of the bomblet housings or a fuse cord disposed on the circumference of the bomblet housing. Due to the low axial stress on the bomblet, it is possible to construct economical and easily manufactured housing configurations which may be composed, for example, of a simple cardboard tube with cardboard or plastic discs glued into it or of a one-piece cardboard housing given the shape of a cup.

The invention will now be described in greater detail with reference to several embodiments thereof that are illustrated in the drawing figures.

BRIEF DESCRIPTION OF THE INVENTION

DETAILED DESCRIPTION OF THE PREFERRED EMBODIMENTS

Figure 1:
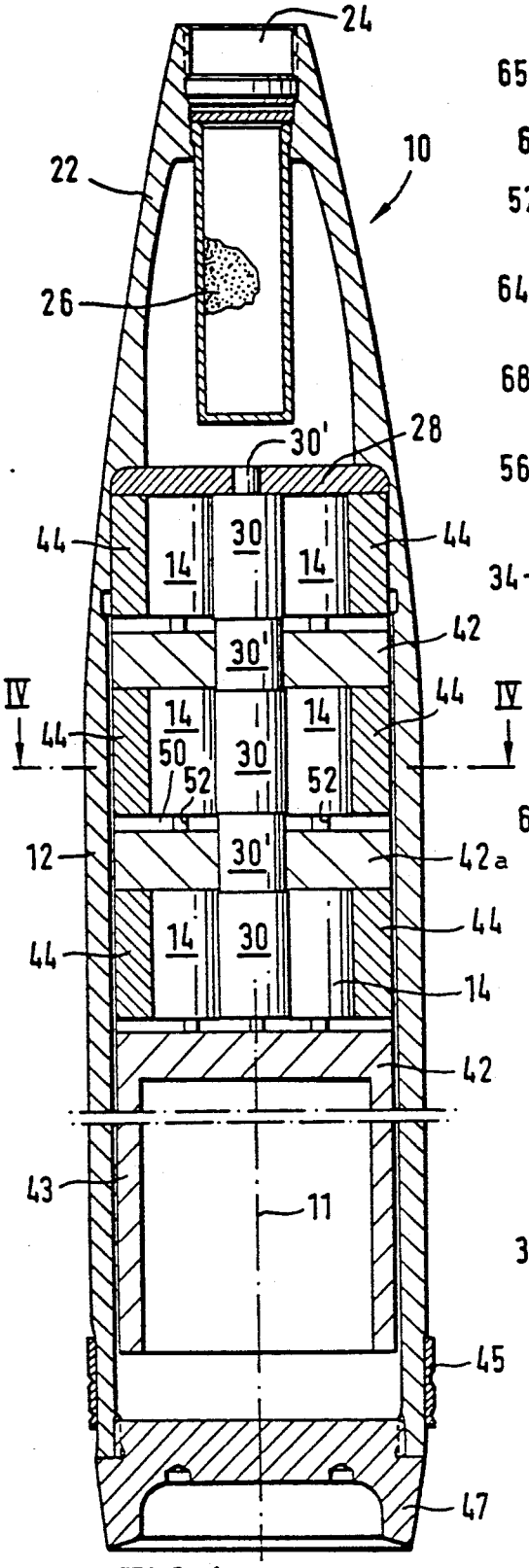
FIG. 1 is a longitudinal sectional view of a bomblet carrier projectile with layers of training bomblets supported therein according to the invention.
Figure 2:
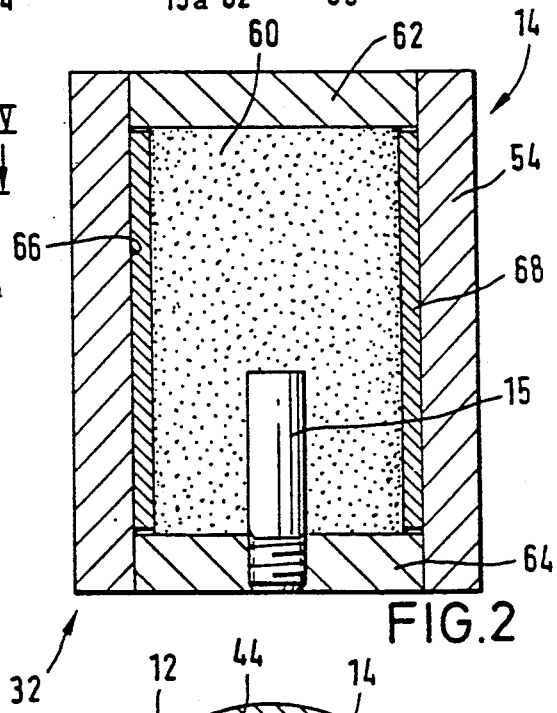
FIG. 2 is a longitudinal sectional view of one embodiment of a training bomblet that can be inserted in the projectile of FIG. 1 according to the invention.

FIG. 1 illustrates a bomblet carrier projectile 10 including a body 12 having a cylindrical region to accommodate training bomblets 14, shown in greater detail in FIG. 2. Other embodiments for the training bomblets are shown in FIGS. 3 and 8 to 11, indicated by reference numerals 16, 18, 20 and 21, as will be discussed below. Projectile body 12 has a frontal ogival projectile region 22 to accommodate a detonator 24 and an ejection unit composed of an ejection charge 26 and an ejector plate 28. Ejector plate 28 includes a central gas passage channel 30' through which ejection charge 26 triggers an ignition delay set 15, 74, 76 provided in each bomblet 14, 16, 18, 20, 21, during the ejection of the training bomblets over the target area.

The training bomblets 14, 16, 18, 20, 21, may be arranged in body 12 in their own individual housings 32, 34, 36, 38, 40 made of a material based on paper and/or plastic.

Figure 4:
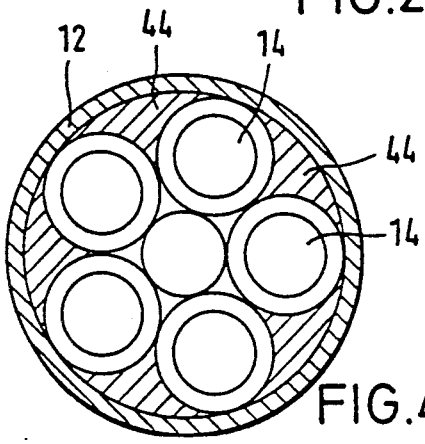
FIG. 4 is a cross-sectional view of the carrier projectile seen along line IV—IV of FIG. 1.

The training bomblets 14 accommodated by bomblet carrier projectile 10 in FIG. 1 are supported in layers within body 12, for which purpose support elements 42, 44 (see FIGS. 1 and 4) or support elements 42, 46 (see FIGS. 5 and 6) are provided which can be stacked in the carrier projectile body 12 in the axial direction of the projectile.

Support element 42 is formed of a disc-shaped support plate disposed underneath adjacent training bomblets 14 of the same layer and transversely to the projectile axis 11. In one embodiment (FIGS. 1 and 4), each support plate 42 is supported relative to an adjacent support plate 42 by an axial support 44, with these axial supports, in order to form a sufficient supporting distance, having a height corresponding to the length of the adjacent bomblets in a given layer.

Between two adjacent support plates 42, axial supports 44 shown in FIG. 1 lie against projectile body 12 and are configured as fillers which fill the free spaces (FIG. 4) between training bomblets 14. In an advantageous manner, these axial supports 44 may also be given different weights and employed, as disclosed in German Patent No. 3,629,668.C1 and corresponding U.S. Pat. No. 4,793,260 to regulate the center of gravity of carrier projectile 10.

Figure 5:
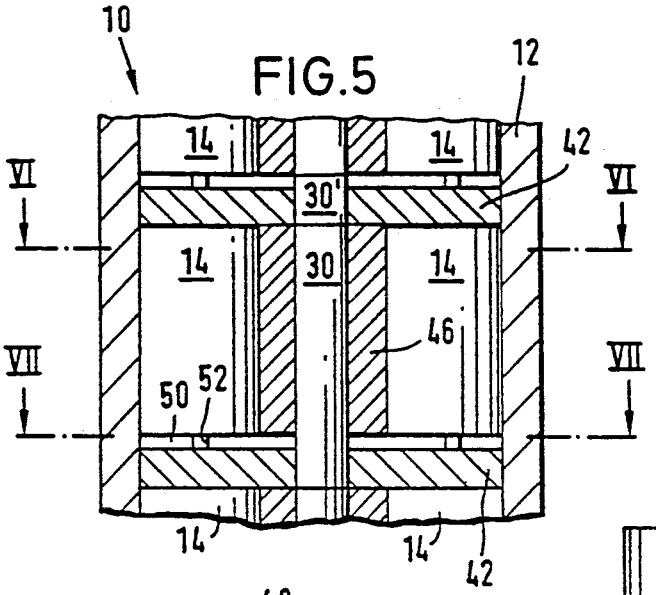
FIG. 5 is a partial longitudinal sectional view of the bomblet carrier projectile including the central axial support of a layer of bomblets according to the invention.
Figure 9:
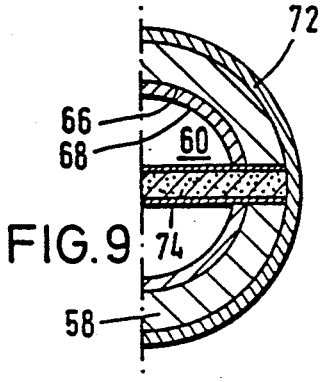
FIG. 9 is a cross-sectional view along line IX—IX of FIG. 8.
Figure 6:
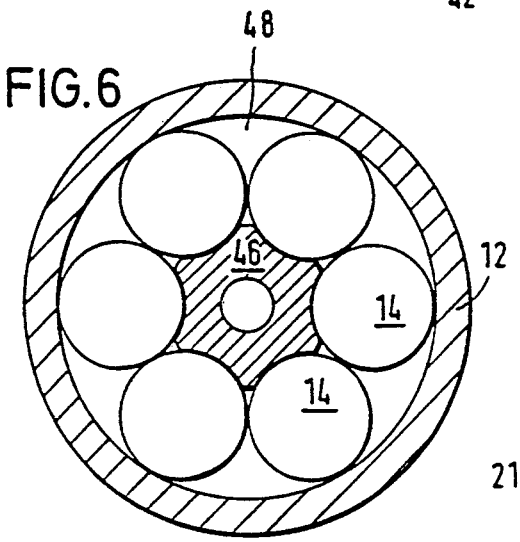
FIG. 6 is a cross-sectional view along line VI—VI of FIG. 5.

Alternatively, as shown in FIGS. 5 and 6, support plates 42 may be supported by a centrally disposed axial support 46 which may be composed of one or several pieces and whose interior forms a section of a central gas passage channel 30' while its exterior lies against the respective radially inwardly oriented bomblet peripheral region of each bomblet 14, 20, 21 disposed in a planar layer. In this embodiment, there are free spaces 48 between bomblets 14 and adjacent projectile body 12. Due to the above-described external configuration of these axial supports 46, the advantage of a mount to radially secure the bomblets and to secure them in the circumferential direction as disclosed in German Patent No. 3,808,898.A1 can be utilized.

An interior space 30 formed by the bomblet arrangement or by a passage through axial support 46 opens in each planar bomblet layer into a central gas passage channel 30' in disc-shaped support plate 42.

Figure 7:
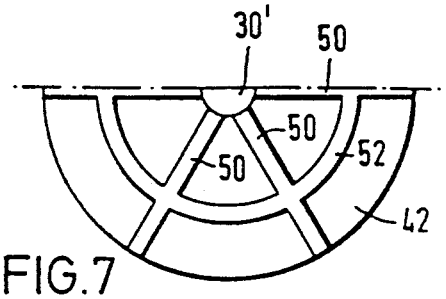
FIG. 7 is a cross-sectional view along line VII—VII of FIG. 5.

Disc-shaped support plate 42 includes, for example, on its side facing the training bomblet, grooves 50, 52, which are shown in detail in FIG. 7, for passage of the gas pressure and the flame to ignite all of the training bomblets disposed on support plate 42. The gas initially flows from axial gas passage channel 30' through radial grooves 50 arranged in a star pattern and from there through circularly extending groove 52 to each training bomblet, igniting an ignition delay set 15, 76 provided at the frontal faces of training bomblets 14, 20, 21 shown in FIGS. 2, 10 and 11, respectively.

A number of training bomblets 14 fills a partial volume of projectile body 12, with the remaining partial volume being filled by a hollow cylinder 43 connected with the lowermost support plate 42*a*. Moreover, bomblet carrier projectile 10 is provided with a known guide band 45 and a projectile base 47 which is released when the bomblets are ejected over the target area.

All or part of the bomblet housings 32, 34, 36, 38, 40 shown in greater detail in FIGS. 2, 3, 8, 10 and 11 are composed of cardboard. Depending on its intended use as a covering tube 54, 56, 58 or as a cover 62, 64, this cardboard may have a weight between 50 and 950 g/m .

Covering tube 54, 56, 58 may be composed of wound paper and may have a greater specific weight than cover 62, 64.

It is also conceivable for all components, that is covering tube 54, 56, 58 and cover 62, 64, or only one of these components, to be composed of polyamide, for example polyamide 12. The components may also be combined, with one part possibly being made of plastic and the other of cardboard or vice versa.

In the preceding cases, the strength of the training bomblet housing 32, 34, 36, 38, 40 made of cardboard and/or plastic must be high enough that the respective training bomblet 14, 16, 18, 20, 21 is able to withstand the firing acceleration of bomblet carrier projectile 10. The housing of the training bomblet is suitable for high firing acceleration, for example, 10,000 g, and is capable of withstanding the force resulting from this.

Due to the material of the housing being cardboard or plastic, a specific weight of less than 1 kg/dm$^3$ can be realized for the entire training bomblet unit so that these training bomblets are able to float.

The bomblet housings 32, 34, 36 shown in FIGS. 2, 3, 8 and 9 include a cardboard or plastic tube 54, 56, 58 as a body and a cardboard or plastic cover 62, 64 for supporting a secondary charge 60 at both its frontal faces.

The spacing of covers 62, 64 is advantageously determined by a spacer tube 68 which lies against the interior 66 of training bomblet housing 32, 34, 36 between covers 62 and 64. Spacer tube 68 may be made of cardboard or plastic and is connected with the tubes 54, 56, 58 by way of a glue connection. Covers 62 and 64 are also connected by way of a glue connection with the tubes 54, 56, 58 of the training bomblet.

The training bomblet 14 shown in FIG. 2 includes a pyrotechnic fuze which is equipped with an ignition delay set 15 fastened, for example by a screw connection, on lowermost cover 64 so as to project into secondary charge 60. Thus the fuze can easily be ignited by the flame of ejection charge 26 which hurries through gas passage channel 30 and grooves 50, 52. Such ignition delay sets 15 are known and ignite secondary charge 60 after a given time subsequent to the impact of the training bomblets o the ground of the target area. Both covers 62 and 64 together with housing tube 54 form a closed cylindrical bomblet housing 32.

Figure 3:
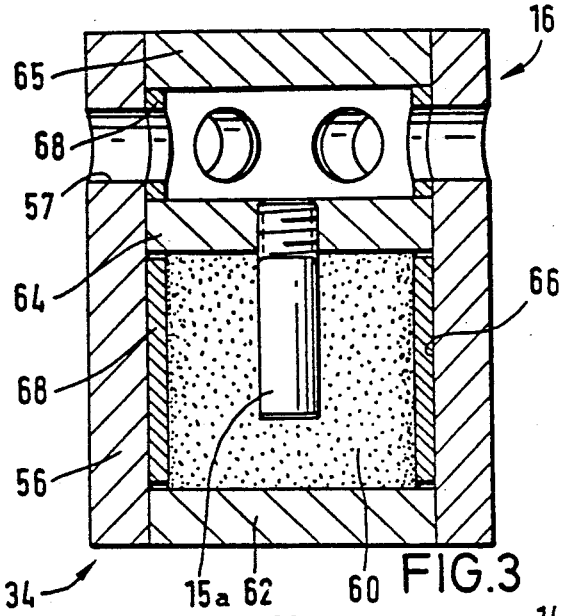
FIG. 3 is a longitudinal sectional view of a further embodiment of a training bomblet that can be inserted in the projectile of FIG. 1 according to the invention.

In the housing 34 shown in FIG. 3, tube 56 projects beyond upper cover 64, with upper cover 64 carrying the ignition delay set 15*a* which here projects downwardly into secondary charge 60. Housing tube 56 is provided with lateral bores 57 through which the ignition flame travels from gas passage 30 for igniting ignition delay set 15. Above bores 57, a further cover 65 and a further spacer tube 68 may be connected to tube 56 in the interior.

Figure 8:
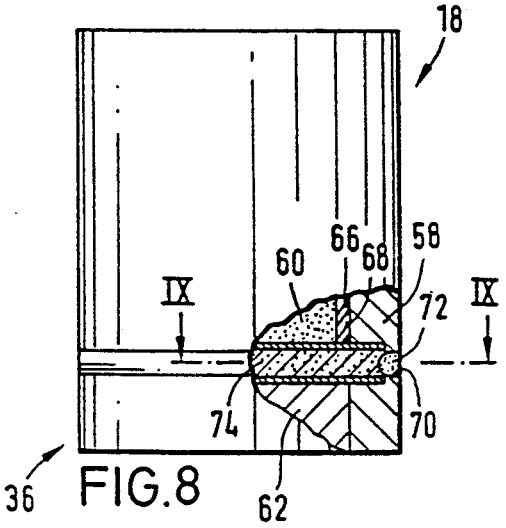
FIG. 8 is a side view of a training bomblet with annular ignition according to another embodiment of the invention.

The training bomblet 18 shown in FIG. 8 also can be ignited directly by the flame hurrying through gas passage channel 30. For this purpose, the housing tube 58 of training bomblet housing 36 is provided with circumferential groove 70 on its exterior to accommodate a fuse cord 72 by means of which an ignition delay set 74 projecting radially into secondary charge 60 can be ignited, with ignition delay set 74 possibly lying on lower cover 62 in a supporting manner.

Figures 10, 11:
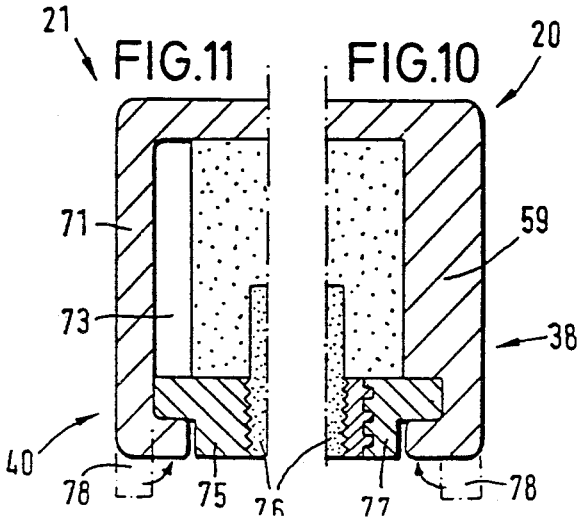
FIGS. 10 and 11 are longitudinal sectional views of respective embodiments of a cup-shaped training bomblet equipped with a flanged fastening ring for an ignition delay unit.

The use of a cardboard and/or plastic material also permits in an advantageous manner the manufacture of a one-piece bomblet housing 38, 40 which, according to FIGS. 10 and 11, includes cup-shaped embodiments. Such bomblet housings 38, 40, composed, for example, of cardboard, may be manufactured according to the Mulch process, with the tubular walls 59 (FIG. 10) being comparatively thick for purposes of stabilization. Alternatively, tubular walls 71 may be reinforced with longitudinal ribs 73 as shown in FIG. 11.

In order to fasten ignition delay set 76, which is here inserted from the bottom by way of a flange 75, 77, the end 78 of housing walls 59, 71, which initially projects axially downwardly may be given the shape of a radial flange.

The use of cardboard and/or plastic material for the components of the bomblet housing permits various other embodiments of the training bomblet housing which fall within the scope of the invention but are not illustrated in the drawings and which make it possible, for example, to arrange the training bomblets also in the manner of layered cheese wedges.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A bomblet carrier projectile for delivering training bomblets to a target area, comprising:

a projectile body;

a plurality of training bomblets supported in layers within said projectile body, each said training bomblet comprising a housing made of at least one of paper and plastic;

a plurality of supporting means disposed within said body and stackable in the axial direction of said body for supporting the housings of said training bomblets in said layers, each said supporting means comprising a disc-shaped support plate disposed transversely to the longitudinal axis of the projectile body and below the training bomblets in the same layer for providing a planar support for the bomblets in the same layer, each said support plate having an axial gas passage channel and a side facing a respective one of the bomblet layers, said side including a circular groove leading to each bomblet and radially extending grooves connecting the axial gas passage channel with said circular groove for the passage of ignition gases for igniting all bomblets disposed on the respective support plate;

a detonator arranged in a frontal region of said projectile body;

a gas passage channel formed along the longitudinal axis of said projectile body; and ejector means disposed behind said detonator and including an ejection charge for emitting ignition gases when ignited by said detonator that are passed through said gas passage channel for igniting said training bomblets and an ejection plate for ejecting the training bomblets from the projectile body, over a target area, in response to pressure generated by the ignition gases.

2. A bomblet carrier projectile as defined in claim 1, wherein adjacent bomblets in a layer have the same axial length, and each said supporting means further comprises an axial support disposed between two adjacent support plates for supporting said two adjacent support plates at a distance corresponding to the length of the bomblets in a layer.

3. A bomblet carrier projectile as defined in claim 2, wherein the arrangement of bomblets presents free spaces between adjacent bomblets in each layer and each said axial support lies against said body between two adjacent support plates and is shaped to fill the free spaces between adjacent training bomblets in a layer.

4. A bomblet carrier projectile as defined in claim 2, wherein the adjacent bomblets in a layer are disposed in an annular arrangement so that each bomblet presents a radially inwardly oriented peripheral portion and said axial support is disposed centrally of said annular arrangement between two adjacent support plates and includes an interior portion with a gas passage and an exterior surface which lies against the respective radially inwardly oriented peripheral portions of the bomblets in said annular arrangement.

5. A bomblet carrier projectile as defined in claim 1, wherein said bomblet housing comprises cardboard.

6. A bomblet carrier projectile as defined in claim 5, wherein said cardboard for the bomblet housing has a weight between 50 and 950 g/m .

7. A bomblet carrier projectile as defined in claim 1, wherein the bomblet housing comprises polyamide.

8. A bomblet carrier projectile as defined in claim 1, wherein said bomblet housing has a strength which is sufficiently high that the training bomblet can withstand acceleration forces generated during firing of the projectile.

9. A bomblet carrier projectile as defined in claim 1, wherein each bomblet has a specific weight of less than 1 $kg/dm^3$.

10. A bomblet carrier projectile as defined in claim 1, wherein said bomblets each comprise a secondary charge disposed in said housing and said housing comprises a tubular body surrounding said charge and comprising at least one of cardboard and plastic, and a cover comprised of at least one of cardboard and plastic supporting said secondary charge disposed within each end of said tubular body.

11. A bomblet carrier projectile as defined in claim 10, wherein said bomblet housing comprises a spacer tube comprised of at least one of cardboard and plastic and disposed between said covers in the interior of said tubular body.

12. A bomblet carrier projectile as defined in claim 11, wherein said spacer tube and said covers are connected with said tubular body by way of a glue connection.

13. A bomblet carrier projectile as defined in claim 1, wherein said housing comprises a tubular body having an exterior circumferential groove and said bomblet further comprises a secondary charge disposed within said tubular body, a delay set projecting radially into said secondary charge and a fuse cord disposed in said circumferential groove in contacting relationship with a radial end of said delay set.

14. A bomblet carrier projectile as defined in claim 1, wherein said housing comprises a cup shaped body comprised of at least one of cardboard and plastic, said cup shaped body having an open end and a flange surrounding the open end, and said bomblet further comprises a secondary charge disposed within said cup shaped body and a delay set projecting axially into said secondary charge and supported by the flange at said open end.

* * * * *